US009188291B2

(12) United States Patent
Cassidy et al.

(10) Patent No.: US 9,188,291 B2
(45) Date of Patent: Nov. 17, 2015

(54) LINEAR LIGHT FIXTURE WITH DIFFUSER

(75) Inventors: Todd Edwin Cassidy, Medina, OH (US); Xiaoning Wang, Xi'an (CN); William Matthew Witt, Concord Township, OH (US); Hexi Qin, Shanghai (CN)

(73) Assignee: GE LIGHTING SOLUTIONS LLC, East Cleveland, OH (US)

( * ) Notice: Subject to any disclaimer, the term of this patent is extended or adjusted under 35 U.S.C. 154(b) by 0 days.

(21) Appl. No.: 14/002,992

(22) PCT Filed: Jul. 6, 2012

(86) PCT No.: PCT/CN2012/078278

§ 371 (c)(1), (2), (4) Date: Sep. 4, 2013

(87) PCT Pub. No.: WO2014/005321

PCT Pub. Date: Jan. 9, 2014

(65) Prior Publication Data

US 2015/0116990 A1 Apr. 30, 2015

(51) Int. Cl.
*F21V 7/20* (2006.01)
*F21V 29/00* (2015.01)
(Continued)

(52) U.S. Cl.
CPC . *F21K 9/54* (2013.01); *A47F 3/001* (2013.01); *F21S 4/008* (2013.01); *F21V 5/04* (2013.01);
(Continued)

(58) Field of Classification Search
CPC ..... F21K 9/54; F21S 4/008; F21V 23/005; F21V 13/14; F21V 29/70; F21V 3/00; F21V 5/04; F21V 7/005; F21V 7/0091; F21V 17/104; F21W 2131/405; F21Y 2101/02; F21Y 2103/003; A47F 3/001; A47F 11/10; A47B 2220/0077
USPC ..... 362/217.01, 218, 219, 222, 217.02, 362/217.05
See application file for complete search history.

(56) References Cited

U.S. PATENT DOCUMENTS 2,929,227 A * 3/1960 Rainwater ..... 62/256
5,508,898 A 4/1996 McGovern
(Continued)

FOREIGN PATENT DOCUMENTS

CN 201284960 Y 8/2009
CN 201803227 U 4/2011
(Continued)

OTHER PUBLICATIONS

PCT Search Report and Written Opinion from corresponding PCT Application No. PCT/CN2012/078278, Dated Mar. 25, 2013.

*Primary Examiner* — Anh Mai
*Assistant Examiner* — Glenn Zimmerman
(74) *Attorney, Agent, or Firm* — GE Global Patent Operation; Peter T. DiMauro

(57) ABSTRACT

A light fixture is provided that includes a plurality of light emitting sources, such as e.g., LEDs, that are arranged along a longitudinal direction. A heat sink provides a support structure for the lights while also assisting with the dissipation of heat. A diffuser covers the light emitting sources and is also supported by the heat sink. One or more optical elements such as e.g., a reflector or internally reflecting lens may be used to help direct light rays from the light emitting sources. Certain features may be added at the ends of the light fixture for mounting upon a surface and/or for further controlling the direction of light rays projecting from the light fixture. The light fixture is suitable for a variety of applications including e.g., the illumination of products displayed on shelving for consumer viewing.

13 Claims, 13 Drawing Sheets

(51) Int. Cl.

| | |
|---|---|
| ***F21K 99/00*** | (2010.01) |
| ***F21S 4/00*** | (2006.01) |
| ***F21V 5/04*** | (2006.01) |
| ***F21V 7/00*** | (2006.01) |
| ***A47F 3/00*** | (2006.01) |
| ***F21V 29/70*** | (2015.01) |
| ***F21V 13/14*** | (2006.01) |
| ***F21V 23/00*** | (2015.01) |
| *F21V 3/00* | (2015.01) |
| *F21V 17/10* | (2006.01) |
| *F21Y 101/02* | (2006.01) |
| *F21Y 103/00* | (2006.01) |
| *A47F 11/10* | (2006.01) |
| *F21W 131/405* | (2006.01) |

(52) U.S. Cl.

CPC ..... *F21V 7/005* (2013.01); *F21V 7/0091* (2013.01); *F21V 13/14* (2013.01); *F21V 23/005* (2013.01); *F21V 29/70* (2015.01); *A47B 2220/0077* (2013.01); *A47F 11/10* (2013.01); *F21V 3/00* (2013.01); *F21V 17/104* (2013.01); *F21W 2131/405* (2013.01); *F21Y 2101/02* (2013.01); *F21Y 2103/003* (2013.01)

(56) References Cited

U.S. PATENT DOCUMENTS

| | | | | |
|---|---|---|---|---|
| 5,626,084 | A | 5/1997 | Kelly et al. | |
| 6,231,205 | B1 * | 5/2001 | Slesinger et al. | 362/133 |
| 6,361,186 | B1 * | 3/2002 | Slayden | 362/241 |
| 6,558,017 | B1 | 5/2003 | Saraiji et al. | |
| 6,827,463 | B2 | 12/2004 | Chuang et al. | |
| 7,121,675 | B2 | 10/2006 | Ter-Hovhannisian | |
| 7,176,501 | B2 | 2/2007 | Lee et al. | |
| 7,396,142 | B2 | 7/2008 | Laizure, Jr. et al. | |
| 7,431,479 | B2 | 10/2008 | Weaver, Jr. et al. | |
| 7,726,831 | B2 | 6/2010 | Shibusawa et al. | |
| 7,806,543 | B2 | 10/2010 | Swofford et al. | |
| 2002/0044456 | A1 * | 4/2002 | Balestriero et al. | 362/555 |
| 2003/0043590 | A1 * | 3/2003 | Walser et al. | 362/494 |
| 2003/0189829 | A1 * | 10/2003 | Shimizu et al. | 362/240 |
| 2004/0114366 | A1 * | 6/2004 | Smith | F21S 48/328 362/247 |
| 2008/0100772 | A1 | 5/2008 | Lin et al. | |
| 2009/0219713 | A1 * | 9/2009 | Siemiet et al. | 362/218 |
| 2010/0110679 | A1 * | 5/2010 | Teng et al. | 362/235 |
| 2010/0128485 | A1 * | 5/2010 | Teng et al. | 362/294 |
| 2010/0232154 | A1 * | 9/2010 | Chen | 362/235 |
| 2010/0328945 | A1 * | 12/2010 | Song et al. | 362/240 |
| 2012/0002396 | A1 | 1/2012 | Tseng et al. | |
| 2012/0212950 | A1 * | 8/2012 | Wei | 362/218 |
| 2012/0262941 | A1 * | 10/2012 | Min | 362/607 |
| 2013/0271977 | A1 * | 10/2013 | Ronen | F21V 15/013 362/235 |
| 2014/0204572 | A1 * | 7/2014 | Spinelli | 362/223 |

FOREIGN PATENT DOCUMENTS

| | | |
|---|---|---|
| CN | 202144956 | 2/2012 |
| EP | 2400212 | 12/2011 |
| WO | 9516375 | 6/1995 |
| WO | 2005119124 | 12/2005 |
| WO | 2008137275 | 11/2008 |
| WO | 2010046887 | 4/2010 |
| WO | 2011046593 | 4/2011 |

* cited by examiner

LINEAR LIGHT FIXTURE WITH DIFFUSER

FIELD OF THE INVENTION

The subject matter of the present disclosure relates generally to a light fixture, and more particularly, to a light fixture having multiple light sources arranged in a linear or substantially linear manner.

BACKGROUND OF THE INVENTION

The illumination of items placed on a shelf or series of shelves presents certain challenges. Depending on the location of the light source, one shelf may block light from illuminating another shelf. Similarly, if a light is placed to one side, large items closest to the light may block light from illuminating other items on the same shelf.

Aesthetics can also be a concern particularly when attempting to optimize the positioning of the light source to address the above-mentioned illumination issues. For example, in a commercial setting where the items being displayed are e.g., consumer products, it is desirable to properly illuminate the consumer products without blocking the consumer's view or detracting from the presentation of the products. Additionally, variables such as the color and intensity of the lighting can be particularly important.

The use of light sources such as light emitting diodes, halogen bulbs, and others can present additional issues. For example, certain types of light sources can generate significant amounts of heat. This heat must be properly dissipated to e.g., avoid damaging the light fixture or improperly heating surfaces near the light fixture. If the application involves an environment where moisture may be present, such as e.g., a refrigerated display case, it may also be necessary to protect the light sources and/or associated electronics from exposure to such moisture.

Accordingly, a light fixture that can provide light from a linear source—i.e. a source where one or more light sources are aligned substantially along a longitudinal direction—would be particularly useful for certain applications. For example, such an arrangement could be used to provide lighting for items placed along a shelf or series of shelves. Such a light fixture that can also be used to provide e.g., the desired color and intensity of light would also be beneficial. Additionally, such a light fixture that can also be provided with features for varying the direction of the light would also be useful.

BRIEF DESCRIPTION OF THE INVENTION

The present invention provides a light fixture that includes a plurality of light emitting sources, such as e.g., LEDs, which may be arranged along a longitudinal direction. At least one heat sink provides a support structure for the light emitting sources while also assisting with the dissipation of heat. A diffuser covers the light emitting sources and is also supported by the heat sink. One or more optical elements such as e.g., a reflector or internally reflecting lens, may be used to help direct light rays from the light emitting sources. Certain features may be added at the ends of the light fixture for mounting upon a surface and/or for further controlling the direction of light rays projecting from the light fixture. The light fixture may be suitable for a variety of applications including e.g., the illumination of products displayed on shelving for consumer viewing. Additional aspects and advantages of the invention will be set forth in part in the following description, or may be apparent from the description, or may be learned through practice of the invention.

In one exemplary embodiment, the present invention provides a light fixture that includes at least one heat sink defining a longitudinal direction. At least one circuit board is attached to the heat sink. A plurality of light emitting sources are mounted to the at least one circuit board. The light emitting sources are spaced apart from each other and may be arranged along the longitudinal direction. A diffuser extends along the longitudinal direction and is attached to the heat sink. The diffuser covers the light emitting sources.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 12 is an end view of an exemplary lens of the present invention while

The use of the same or similar reference numerals in the figures indicates the same or similar features.

DETAILED DESCRIPTION OF THE INVENTION

Figure 1:
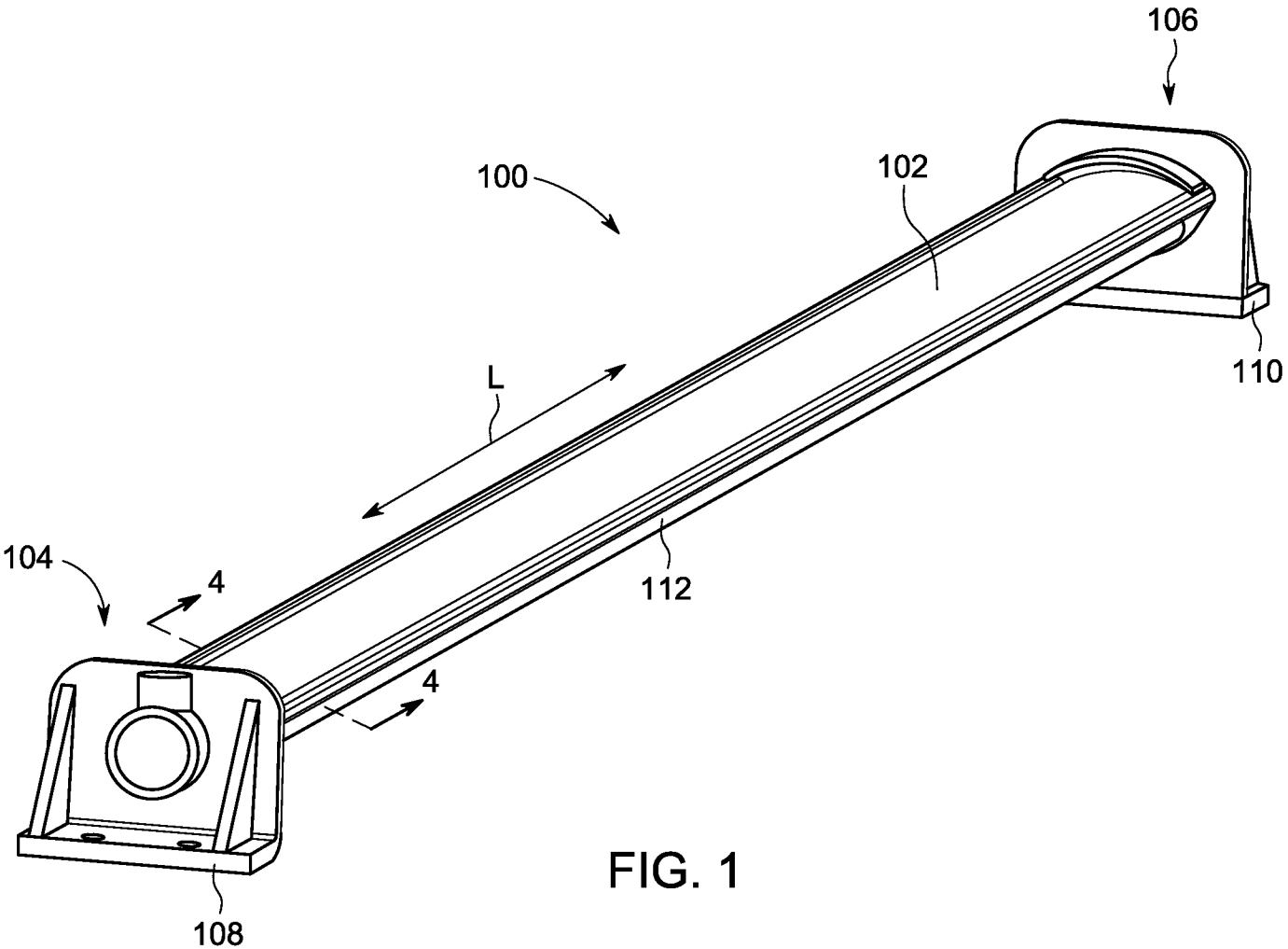
FIG. 1 provides a perspective view of an exemplary embodiment of a light fixture of the present invention with an exemplary diffuser shown in position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
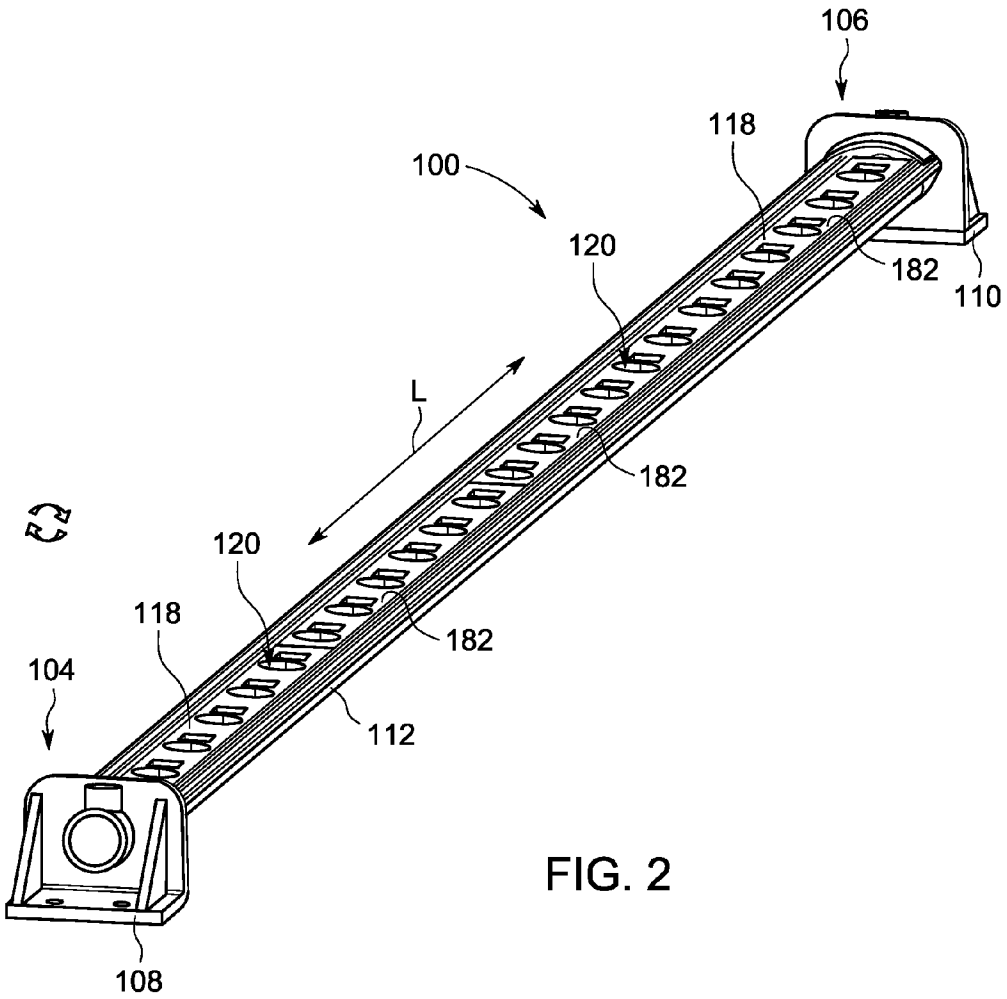
FIG. 2 provides another perspective view of the exemplary embodiment of FIG. 1 without the exemplary diffuser.
Figure 3:
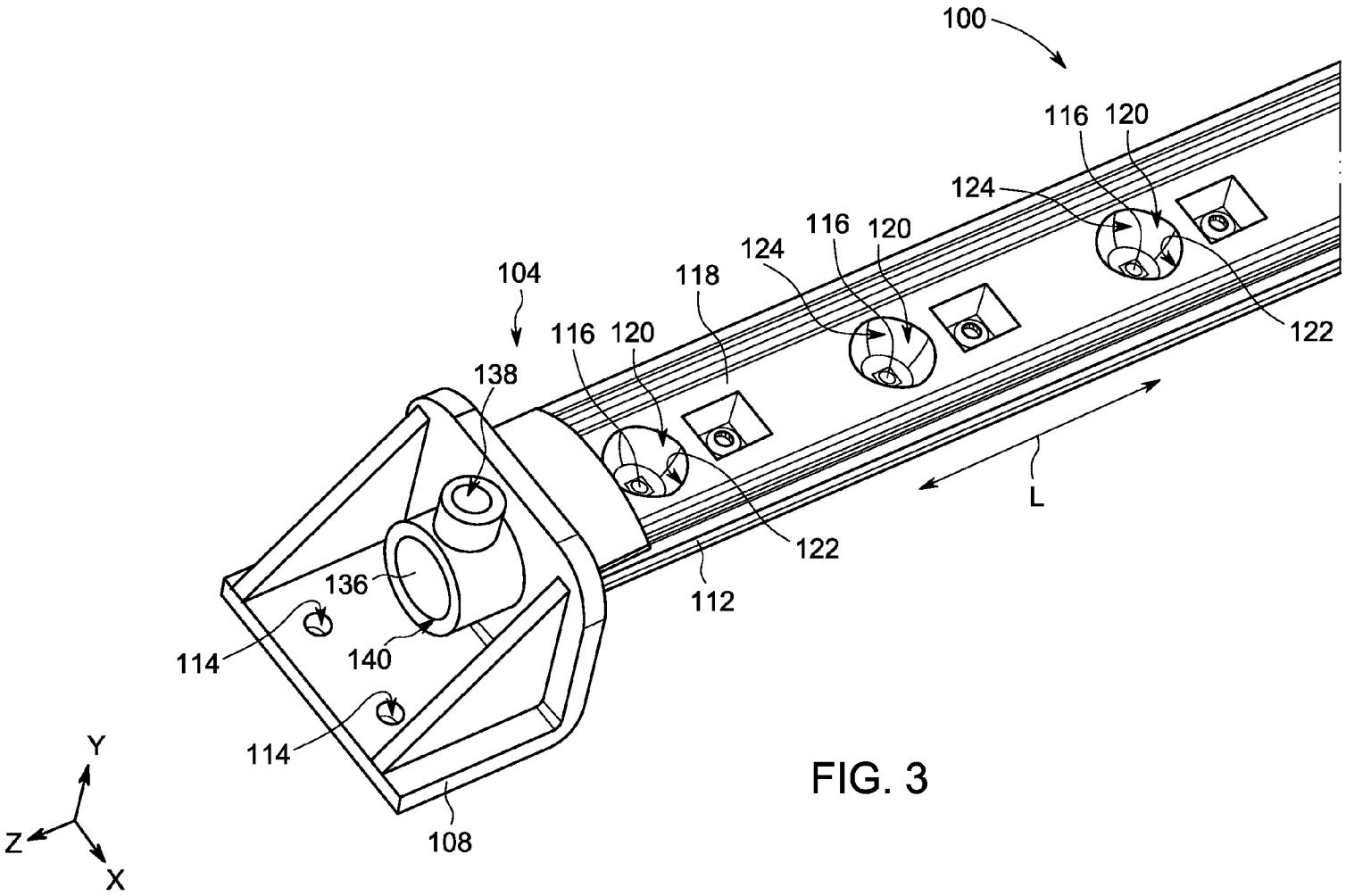
FIG. 3 illustrates a perspective view of one end of the exemplary light fixture of FIG. 1 with certain mounting features shown in place.

FIGS. 1 and 2 provide a perspective view of an exemplary embodiment of a light fixture 100 of the present invention. A diffuser 102 is shown in position in FIG. 1 while in FIG. 2 diffuser 102 has been removed to reveal other components. FIG. 3 provides close-up view of a first end 104 of fixture 100.

Light fixture 100 includes a heat sink 112 that extends along longitudinal direction L between first end 104 and a second end 106. Each end 104 and 106 includes a bracket 108 and 110, respectively. Brackets 108 and 110 may be used to mount fixture 100 to a surface. Apertures 114 in each bracket 108 and 110 may be used along with fasteners for such mounting. Other features may be used for mounting light fixture 100 as well. By way of example, light fixture 100 could be mounted at the top and/or bottom of a refrigerated display case and used to illuminate products on shelves in the case. Light fixture 100 may be used in other applications as well.

Fixture 100 includes a plurality of light emitting sources 116 spaced apart from each other and arranged along longitudinal direction L as shown. Each light emitting sources 116 may be e.g., one or more light emitting diodes (LEDs). The density and number of LEDs along longitudinal direction L can be determined based on e.g., the application intended for fixture 100. As shown in FIG. 2, light emitting sources 116 are positioned in a straight-line manner along the longitudinal direction. However, it should be understood that it is within the scope of the present invention for light sources 116 to be arranged in other manners, e.g., arranged longitudinally but not necessarily along a straight-line as shown in FIG. 2, or arranged laterally.

For this exemplary embodiment, a reflector 118 is provided that also extends along longitudinal direction L. Reflector 118 defines a plurality of cavities (or recesses) 120 that are also spaced apart and positioned along longitudinal direction L. More particularly, each cavity 120 is positioned around or otherwise contains at least one of the light emitting sources 116 and includes one or more light reflecting surfaces 122 and 124 for reflecting light away from light fixture 100. By way of example, reflector 118 could be constructed from a metallized plastic so as to provide light reflective surfaces 122 and 124. Light reflected from surfaces 122 and 124 passes through diffuser 102. For this exemplary embodiment, diffuser 102 is constructed from a material of uniform thickness that helps control e.g., the color and/or distribution of the light.

Figure 4:
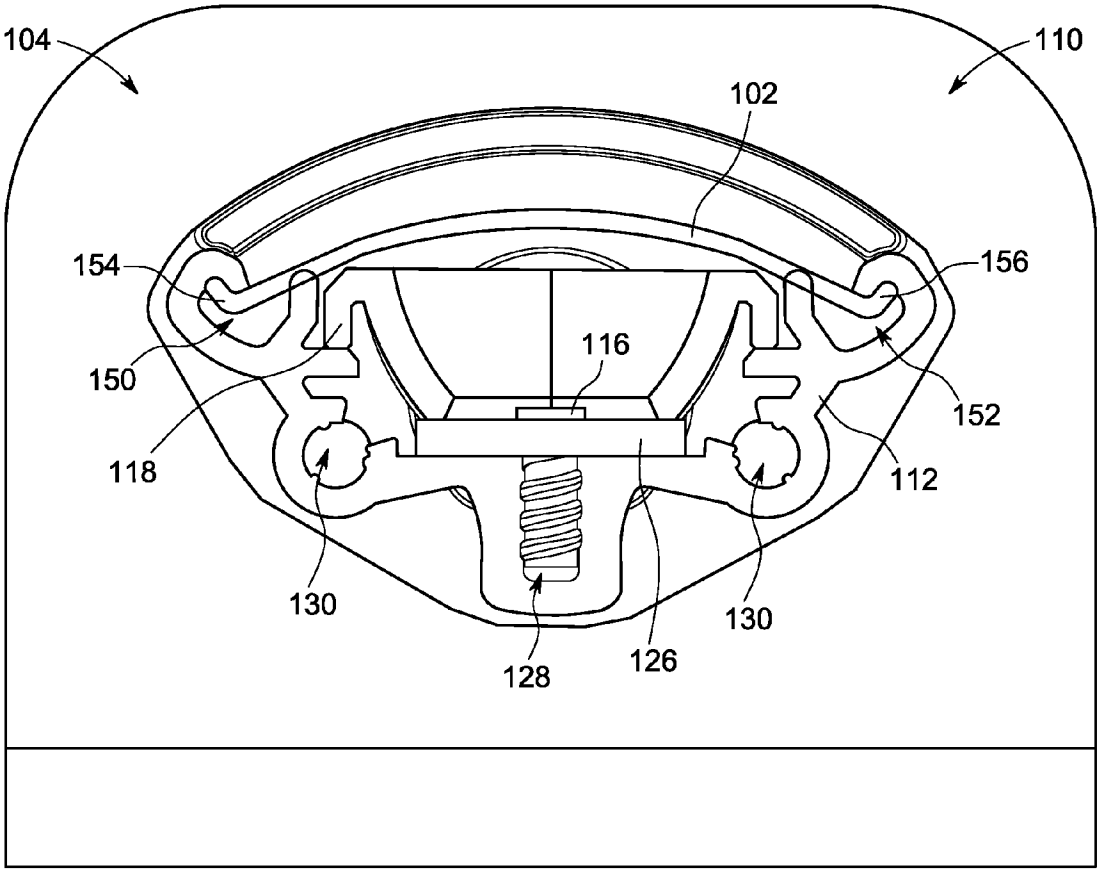
FIG. 4 is a cross-sectional view of the exemplary embodiment of FIG. 1 as taken along line 4-4 in FIG. 1.
Figure 5:
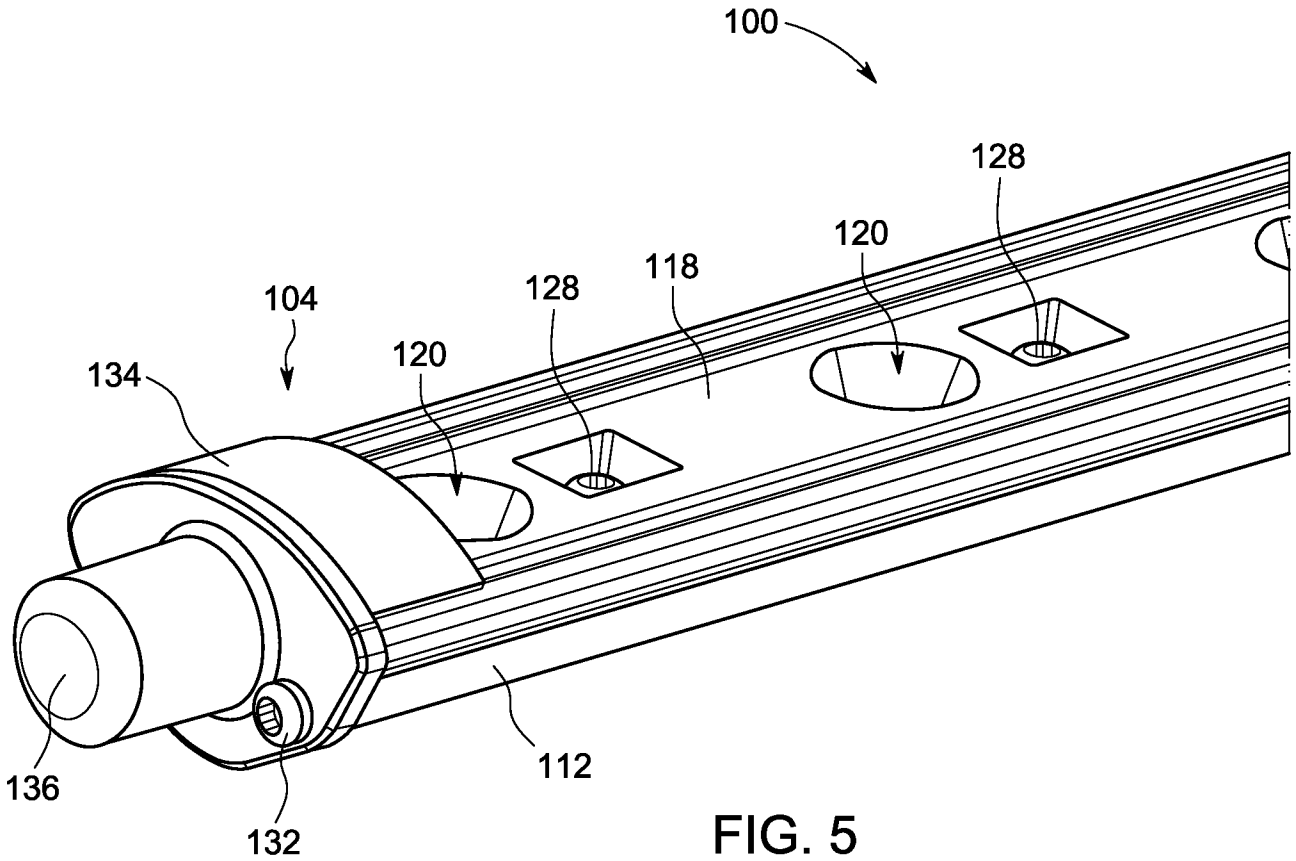
FIG. 5 is another perspective view of one end of the exemplary light figure of FIG. 1 with an exemplary mounting feature—i.e. an end cap—shown in place.

FIG. 4 provides cross-sectional view of first end 104 while FIG. 5 provides a perspective view of first end 104 with a cap 134 in place. Reflector 118 is mounted to a circuit board such as e.g., a fiberglass reinforced printed circuit board 126. Reflector 118 can be attached using e.g., fasteners 132. Other fastening mechanisms may also be used. For example, reflector 118 could be manufactured with pegs that provide an interference fit with holes or openings in circuit board 126.

Circuit board 126 also extends along longitudinal direction L and is attached to heat sink 112. By way of example, circuit board 126 could be provided with fasteners or pegs that extend into a slot 128 provided by heat sink 112 and positioned at the bottom of circuit board 126. Heat sink 112 is constructed from one or materials that help dissipate heat created by light emitting sources 116. Heat sink 112 also provides the structure or frame for light fixture 100. By way of example, heat sink 112 could be constructed from anodized aluminum. For this exemplary embodiment, heat sink 112 is configured to resist collecting dirt and debris, to be readily cleanable by e.g., wiping, and still have substantial surface area for convective cooling.

Figure 6:
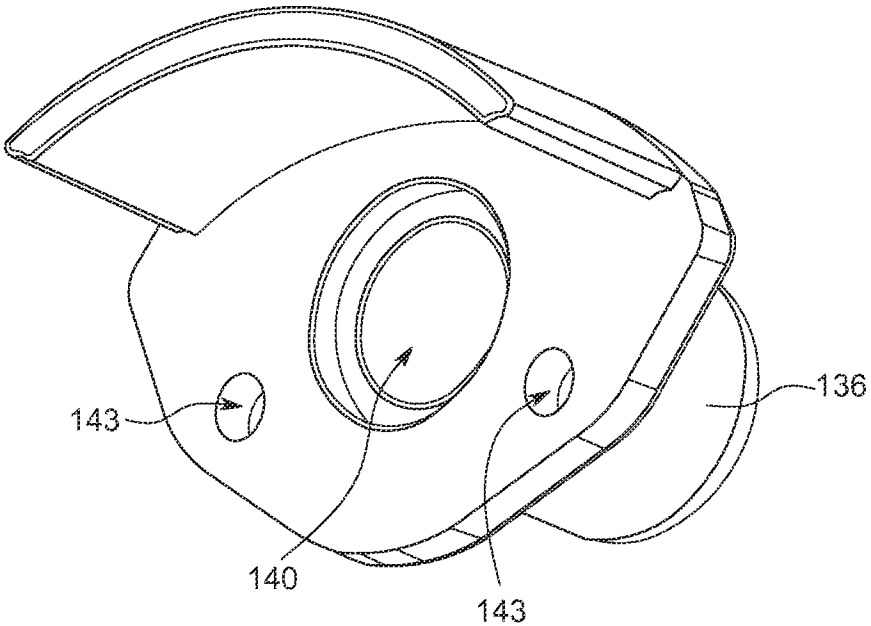
FIG. 6 illustrates a perspective view of the exemplary end cap of FIG. 5.

Ends 104 and 106 each include apertures 130 that are oriented along longitudinal direction L. Apertures 130 are configured for the receipt of fasteners 132 that extend through apertures 143 (FIG. 6) in cap 134 to secure cap 134 onto end 104. As shown in FIG. 5, cap 134 includes a peg 136 that extends along longitudinal direction L. Peg 136 is rotatably received into an aperture 140 defined by bracket 108 as shown in FIG. 6. A similar construction is used for a cap (not shown) positioned on second end 106 with bracket 110. As such, after mounting brackets 108 and 110, light fixture 100 can be rotated in the direction desired as the pegs at first end 104 and 106 rotate within brackets 108 and 110. A fastener such as a set screw can be inserted into aperture 138 (FIG. 3) to apply force against peg 136 and fix the rotational position of light fixture 100. A metal insert can be provided that is either heat-staked, ultra-sonically welded, or molded-in to allow such set screw or thumb screw.

Returning to FIG. 4, an exemplary technique for mounting diffuser 102 to heat sink 112 is shown. Heat sink 112 includes a pair of grooves 150 and 152 positioned on opposite sides of reflector 118 and the plurality of light emitting sources 116. Grooves 150 and 152 extend along longitudinal direction L. Diffuser 102 may include a pair of opposing longitudinal edges 154 and 156 that are received in a complementary manner into grooves 150 and 152. Diffuser 102 provides a spring-like force that urges edges 154 and 156 into grooves 150 and 152 to secure the attachment of diffuser 102.

Figure 7:
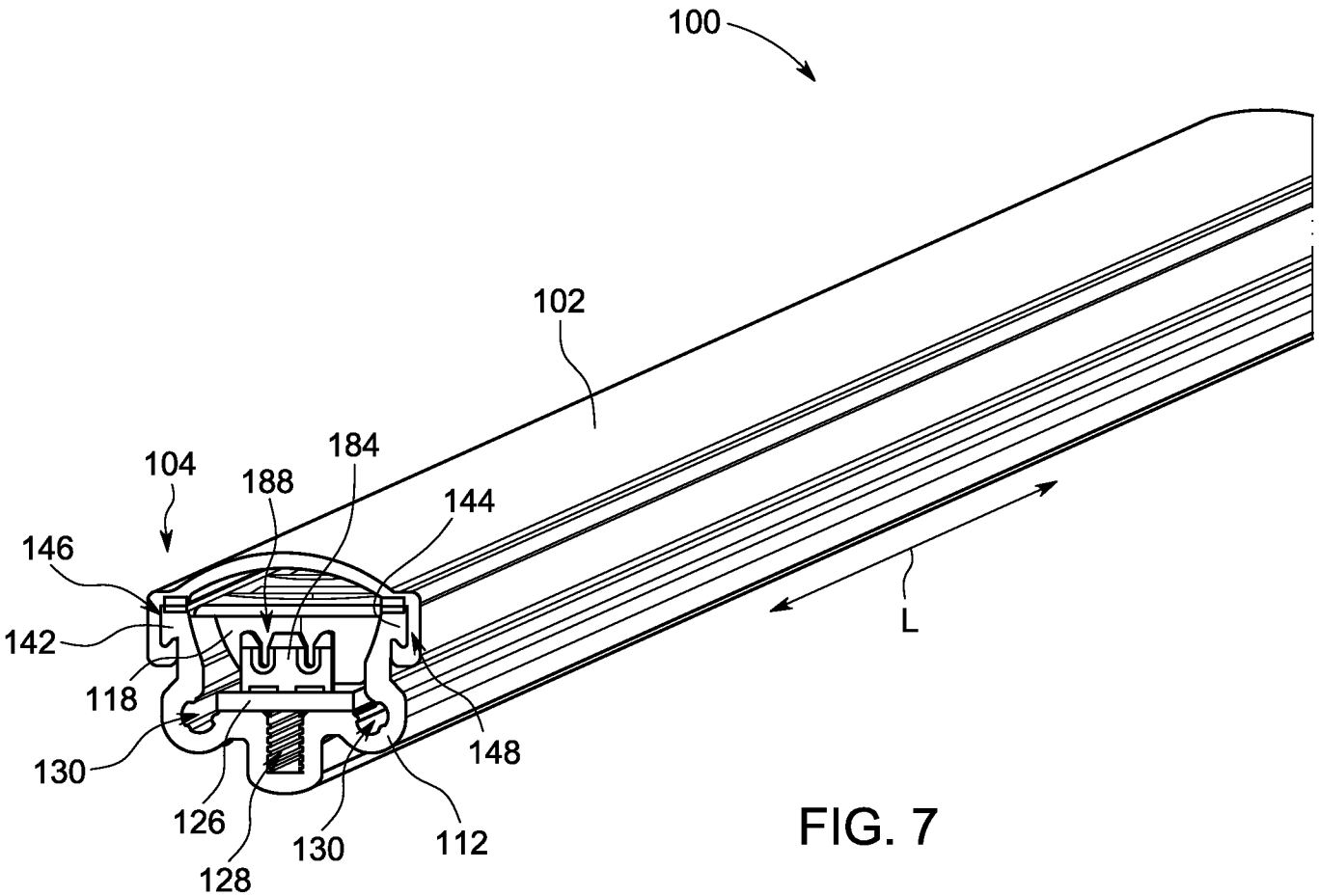
FIG. 7 illustrates a perspective view of one end of another exemplary light fixture where certain mounting features have been removed to reveal interior components of the fixture.

FIG. 7 illustrates another exemplary technique for mounting diffuser 102 to heat sink 112. More specifically, for the exemplary embodiment of FIG. 7, heat sink 112 includes a pair of ribs 142 and 144 positioned on opposite sides and extending along longitudinal direction L. Ribs 142 and 144 project outwardly or face away from each other as well as light emitting sources 116. Diffuser 102 includes a pair of grooves 146 and 148 positioned on opposite sides of diffuser 102 and also extending along longitudinal direction L. As shown, ribs 142 and 144 are received in a complementary manner into grooves 146 and 148, respectively, to secure diffuser 102 into position.

Figure 8:
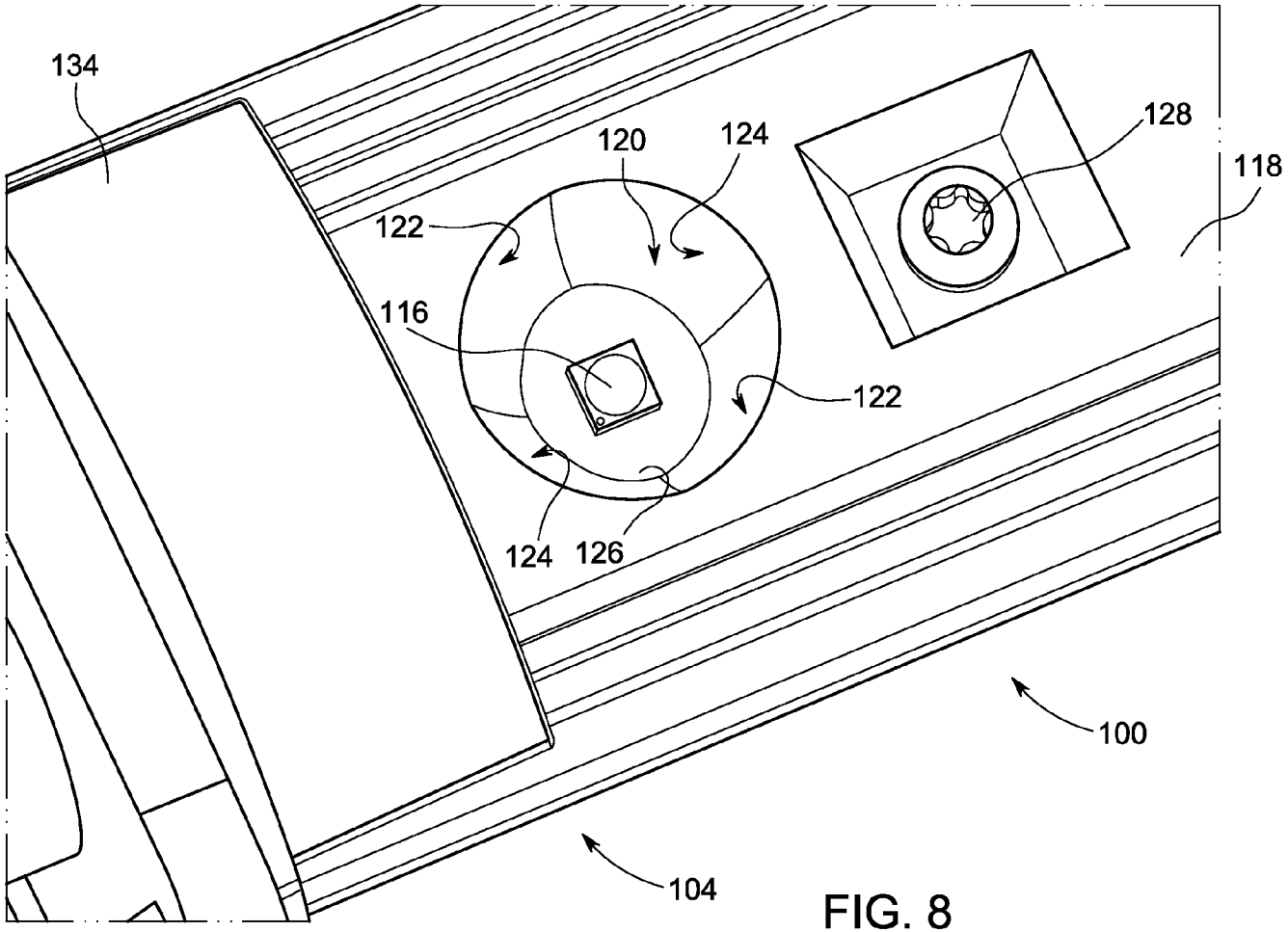
FIG. 8 is a close up of a portion of the exemplary light fixture of FIGS. 1 and 2.
Figure 9:
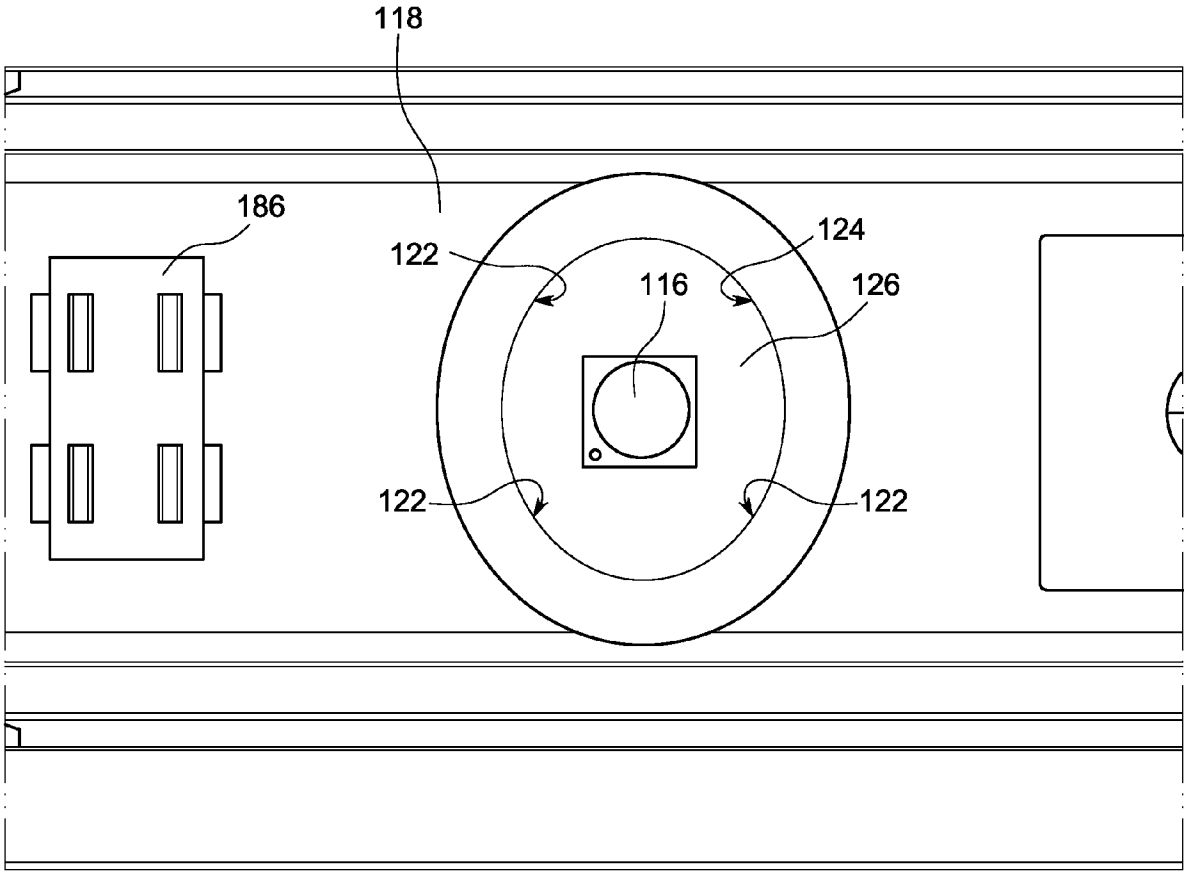
FIG. 9 is a cross-sectional view of a portion of the exemplary light fixture of FIG. 1.

FIG. 8 provides a close up of a cavity 120 at first end 104 of light fixture 100. Cavity 120 includes a first pair of light reflective surfaces 122 positioned in an opposing manner about light emitting source 116. Cavity 120 also includes a second pair of light reflective surfaces 124 positioned in an opposing manner along with the first pair of light reflective surfaces 122 about light emitting source 116. FIG. 9 provides a cross-sectional view of light fixture 100 taken along a plane parallel to circuit board 126 and at a position above light emitting source 116. As shown, the first pair of light reflective surfaces 122 having a first parabolic shape, while the second pair of light reflective surfaces 124 have a second parabolic shape different than the first parabolic shape. The shapes of surfaces 122 and 124 are configured as such to help direct light rays emitted from source 116. In other exemplary embodiments of light fixture 100, other shapes may be used for surfaces 122 and 124 in addition to that which is shown including e.g., non-parabolic shapes.

Figure 10:
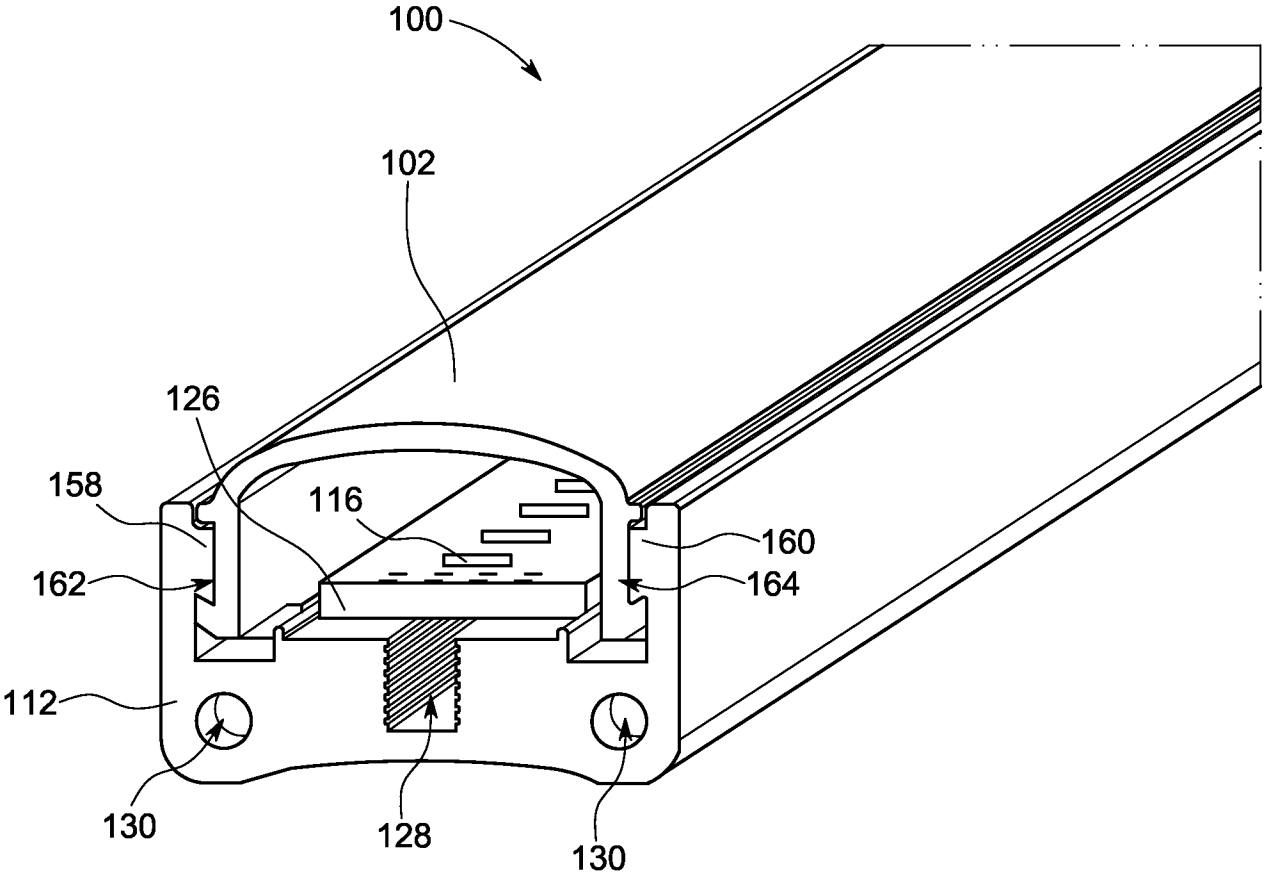
FIG. 10 illustrates a perspective view of the one end of another exemplary light fixture of the present invention.

FIG. 10 illustrates an end view of another exemplary embodiment of a light fixture 100 of the present invention (mounting features have been removed for purposes of illustrating interior components). Unlike the previously described embodiments, the light fixture 100 shown in FIG. 10 does not include a reflector. In addition, FIG. 10 illustrates another exemplary technique for mounting diffuser 102 to heat sink 112. More specifically, for the exemplary embodiment of FIG. 7, heat sink 112 includes a pair of ribs 158 and 160 positioned on opposite sides and extending along longitudinal direction L. Ribs 158 and 160 project inwardly or face towards each other as well as light emitting sources 116. Diffuser 102 includes a pair of grooves 162 and 164 positioned on opposite sides of diffuser 102 and also extending along longitudinal direction L. As shown, ribs 158 and 160 are received in a complementary manner into grooves 162 and 164, respectively, to secure diffuser 102 into position.

Figure 11:
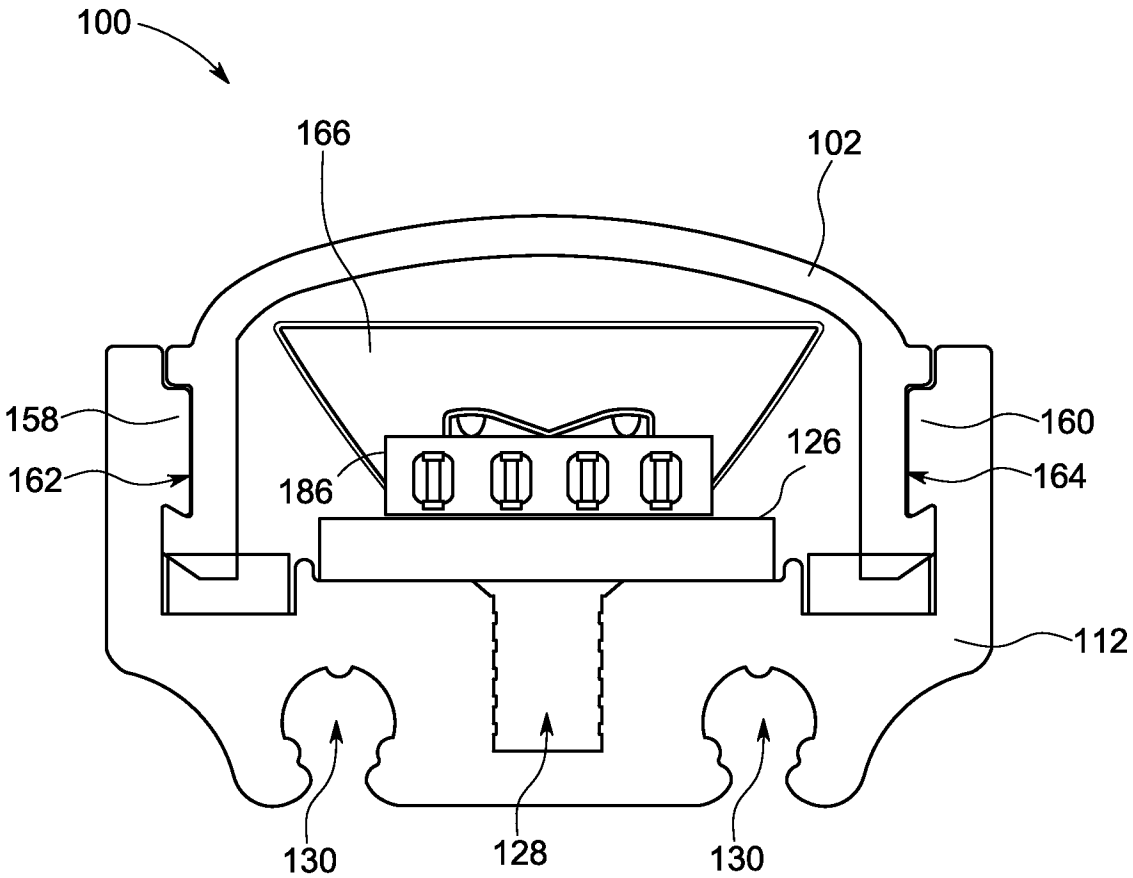
FIG. 11 is a cross-sectional, end view of another exemplary light fixture of the present invention.
Figure 12:
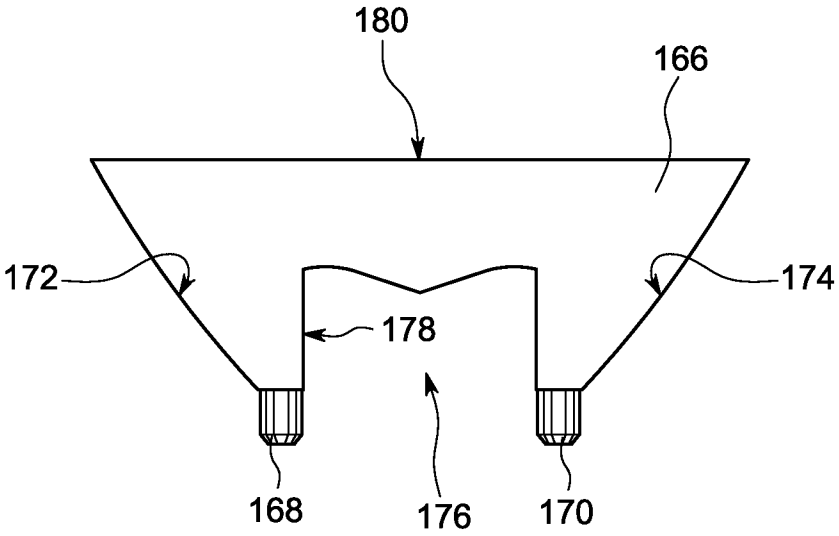
Figure 13:
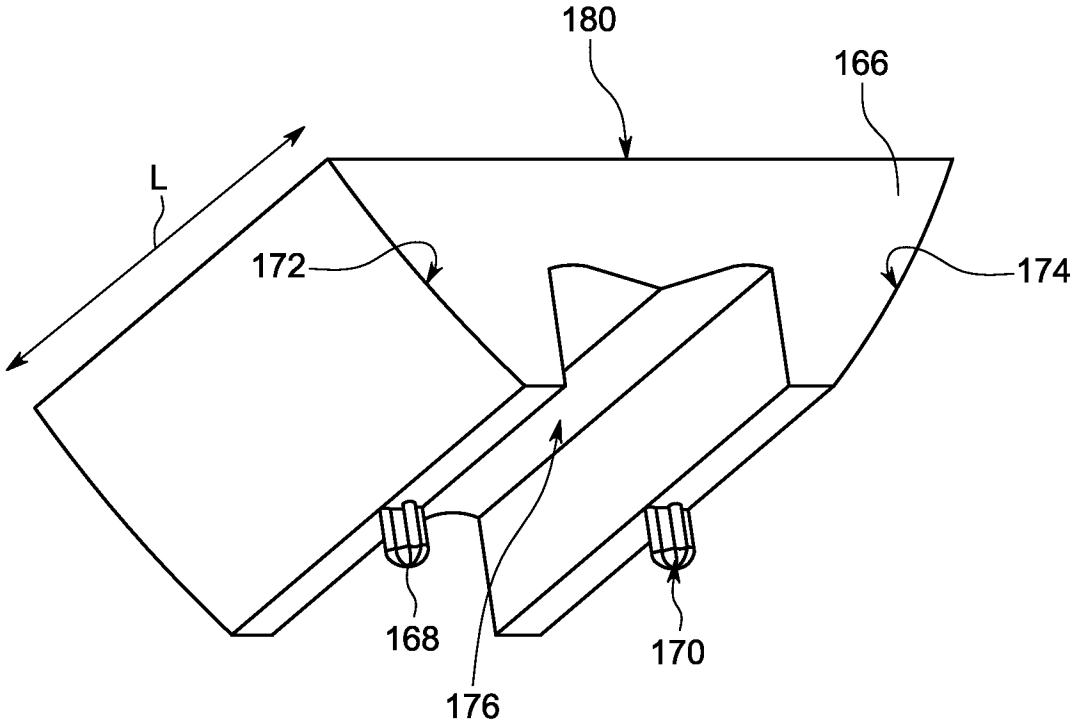
FIG. 13 is a perspective view of the same.

FIG. 11 is a cross-sectional, end view of another exemplary light fixture 100 of the present invention. Unlike previous embodiments, the embodiment of FIG. 11 includes an optical element or lens 166. Referring now to FIGS. 11, 12, and 13, lens 166 extends along longitudinal direction L and is positioned directly over the plurality of light emitting sources 116, which are received into a channel 176 defined by the inside surface 178 of lens 166. By way of example, lens 166 is provided with a pair of projecting inserts 168 and 170 that are received into circuit board 126 to secure lens 166 using an interference fit. Other features may be used to secure lens 166 as well.

Lens 166 includes a pair of internally reflecting surfaces 172 and 174. For this exemplary embodiment, surfaces 172 and 174 may be arcuate in shape (and each may provide an external surface that is convex) within a plane that is orthogonal to longitudinal direction L as shown in FIG. 12. As such, some of the light rays from light sources 116 will enter lens 166 through inside surface 178, reflect off of surfaces 172 and 174, and exit lens 166 through outer surface 180. Other shapes for surfaces 172, 174, 178, and 180 may also be used in an effort to direct light rays from light emitting sources 116 away from light fixture 100. By way of example, lens 166 can be manufactured from a polycarbonate or an acrylic material. Lens 166 may be constructed in a variety of lengths to cover one or several light emitting sources 116.

Light fixture 100 can be constructed in a modular manner to help simplify manufacture. For example, referring to FIG. 2, a series of modules 182 can be installed on a heat sink 112 that is cut to the desired length. For example, heat sink 112 may be cut to a length of four feet to accept four modules 182, each constructed at a one foot length. In turn, each module 182 could individually include e.g., a reflector 118 or lens 166, circuit board 126, and one or more light emitting sources 116. Modules 182 can be connected electrically using e.g., connector 184 with wire slots 188 (FIG. 7), mating pin connections 186 (FIG. 9), or other connection mechanisms positioned at the ends of modules 182.

It should be understood that for each exemplary embodiment, diffuser 102 may be constructed with a non-uniform shape and thickness so as to assist in directing light where desired. Additionally, the shape of e.g., diffuser 102 and either reflector 118 or lens 166 can be used together to minimize color separation. For example, lens 166 can be used to focus the light to increase flux density on the target plane while the diffuser 102 can un-focus the light slightly to remove color separation issues.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A light fixture, comprising:
at least one heat sink defining a longitudinal direction;
at least one circuit board attached to said at least one heat sink;
a plurality of light emitting sources mounted to said at least one circuit board, said light emitting sources spaced apart from each other;
a diffuser extending along the longitudinal direction and attached to said at least one heat sink, said diffuser covering said light emitting sources; and
a reflector extending along the longitudinal direction, said reflector defining a plurality of cavities, with each of said cavities containing at least one of said light emitting sources, each of said cavities comprising one or more light reflective surfaces for reflecting light away from the light fixture;
wherein each of said cavities comprises:
a first pair of light reflective surfaces positioned in an opposing manner about at least one of said light emitting sources, said first pair of light reflective surfaces having a first parabolic shape in a plane parallel to said at least one circuit board; and
a second pair of light reflective surfaces positioned in an opposing manner and with said first pair of light reflective surfaces about at least one of said light emitting sources, said second pair of light reflective surfaces having a second parabolic shape in a plane parallel to said at least one circuit board, said second parabolic shape different from the first parabolic shape.

2. The light fixture as in claim 1, further comprising:
at least one lens extending along the longitudinal direction attached to said circuit board, and positioned directly over at least one of said plurality of light emitting sources;
said lens comprising
at least one internally reflective surface for reflecting light away from the light fixture, and
at least one outer surface through which light is emitted from the at least one of said plurality of light emitting sources.

3. The light fixture as in claim 1, further comprising:
a lens extending along the longitudinal direction, attached to said circuit board, and positioned directly over said plurality of light emitting sources;
said lens comprising
at least one internally reflective surface for reflecting light away from the light fixture, and
at least one outer surface through which light is emitted from said plurality of light emitting sources.

4. The light fixture as in claim 1, further comprising a plurality of circuit boards attached to said at least one heat sink, said plurality of circuit boards positioned along the longitudinal direction.

5. The light fixture as in claim 1, wherein each of said plurality of light emitting sources comprises an LED.

6. The light fixture as in claim 1, wherein said at least one heat sink further comprises a pair of grooves positioned on opposite sides of said plurality of light emitting sources and extending along the longitudinal direction, and wherein said diffuser includes a pair of opposing longitudinal edges received into said pair of grooves.

7. The light fixture as in claim 1, wherein said at least one heat sink further comprises a pair of ribs positioned on opposite sides of said plurality of light emitting sources and extending along the longitudinal direction, and wherein said diffuser comprises a pair of opposing longitudinal grooves configured for complementary receipt of said pair of ribs.

8. The light fixture as in claim 1, wherein said plurality of light emitting sources are arranged along the longitudinal direction.

9. A refrigerated display case including the light fixture of claim 1.

10. The light fixture as in claim 2, wherein said internally reflective surface comprises a pair of opposing, internally reflective surfaces that are each arcuate in shape within a plane that is orthogonal to the longitudinal direction.

11. The light fixture as in claim 2, wherein said at least one lens comprises a plurality of lens attached to said circuit board and positioned adjacent to each other along the longitudinal direction, wherein each lens of said plurality of lens is positioned directly over at least one of said plurality of light emitting sources.

12. The light fixture as in claim 10, wherein said outer surface lies substantially within a plane that is parallel to the longitudinal direction.

13. A light fixture, comprising:

at least one heat sink defining a longitudinal direction;

at least one circuit board attached to said at least one heat sink;

a plurality of light emitting sources mounted to said at least one circuit board, said light emitting sources spaced apart from each other; and a diffuser extending along the longitudinal direction and attached to said at least one heat sink, said diffuser covering said light emitting sources;

wherein said at least one heat sink extends between a pair of ends, and wherein said light fixture further comprises:

a pair of caps attached to said pair of ends, respectively, each said cap comprising:

a peg extending along the longitudinal direction;

the light fixture further comprising:

a pair of brackets for suspending the light fixture from a surface, each said bracket defining an aperture for rotationally receiving the peg of a respective cap; and a set screw installed in one of said brackets for fixing a rotational position of the light fixture.

* * * * *